US009225089B2

(12) United States Patent
Sato

(10) Patent No.: US 9,225,089 B2
(45) Date of Patent: Dec. 29, 2015

(54) ELECTRICAL CONNECTOR

(71) Applicant: IRISO ELECTRONICS CO., LTD., Kanagawa (JP)

(72) Inventor: Katsumasa Sato, Kanagawa (JP)

(73) Assignee: IRISO ELECTRONICS CO., LTD., Kanagawa (JP)

( * ) Notice: Subject to any disclaimer, the term of this patent is extended or adjusted under 35 U.S.C. 154(b) by 0 days.

(21) Appl. No.: 14/538,488

(22) Filed: Nov. 11, 2014

(65) Prior Publication Data

US 2015/0132976 A1 May 14, 2015

(30) Foreign Application Priority Data

Nov. 13, 2013 (JP) ..... 2013-235107
Jun. 20, 2014 (JP) ..... 2014-003271 U

(51) Int. Cl.

| | |
|---|---|
| ***H01R 12/71*** | (2011.01) |
| ***H01R 4/02*** | (2006.01) |
| ***H01R 12/73*** | (2011.01) |
| ***H01R 13/24*** | (2006.01) |
| *H01R 12/91* | (2011.01) |

(52) U.S. Cl.

CPC ..... *H01R 12/716* (2013.01); *H01R 4/028* (2013.01); *H01R 12/73* (2013.01); *H01R 13/2457* (2013.01); *H01R 12/91* (2013.01)

(58) Field of Classification Search

CPC .... H01R 12/91; H01R 24/60; H01R 13/6315; H01R 12/716; H01R 4/028; H01R 13/2457; H01R 12/73

USPC ..... 439/676, 74, 247–248, 660, 570

See application file for complete search history.

(56) References Cited

U.S. PATENT DOCUMENTS

| | | | | |
|---|---|---|---|---|
| 4,217,024 | A | | 8/1980 | Aldridge et al. |
| 5,040,991 | A | | 8/1991 | Collier |
| 5,259,779 | A | * | 11/1993 | Ooya et al. ..... 439/247 |
| 5,904,581 | A | | 5/1999 | Pope et al. |

(Continued)

FOREIGN PATENT DOCUMENTS

| | | |
|---|---|---|
| EP | 2093841 A2 | 8/2009 |
| EP | 2442405 A1 | 4/2012 |

(Continued)

OTHER PUBLICATIONS

European Search Report for EP Patent App. No. 14192267.4 (Mar. 30, 2015).

*Primary Examiner* — Edwin A. Leon
(74) *Attorney, Agent, or Firm* — Cermak Nakajima & McGowan LLP; Tomoko Nakajima

(57) ABSTRACT

An electrical connector includes a socket housing and socket terminals. Each socket terminal includes a front terminal and a rear terminal. The front terminal contacts a plug connector inserted into the socket housing. The front terminal includes front contact-point portion that contacts the plug connector and an elastic piece that supports the front contact-point portion so as to be elastically displaceable. The rear terminal includes a rear contact-point portion and an elastic piece that supports the rear contact-point portion so as to be elastically displaceable. The rear contact-point portion contacts the plug connector after the front contact-point portion has contacted the plug connector. The front contact-point portion and the elastic piece, and the rear contact-point portion and the elastic piece are each formed so as to maintain a plate surface of a flat metal plate.

6 Claims, 13 Drawing Sheets

(56) References Cited

U.S. PATENT DOCUMENTS

| | | | | |
|---|---|---|---|---|
| 2002/0142662 | A1 | 10/2002 | Shiroyama et al. | |
| 2006/0276061 | A1* | 12/2006 | Koguchi et al. | 439/74 |
| 2009/0239422 | A1* | 9/2009 | Fukazawa et al. | 439/660 |
| 2012/0135621 | A1 | 5/2012 | Hayauchi | |
| 2012/0252275 | A1 | 10/2012 | Tajiri et al. | |
| 2014/0134890 | A1 | 5/2014 | Kobayashi et al. | |

FOREIGN PATENT DOCUMENTS

| | | | |
|---|---|---|---|
| JP | 08-195255 | A | 7/1996 |
| JP | 2009-199766 | A | 9/2009 |
| JP | 2010-040309 | A | 2/2010 |
| JP | 2011-040206 | A | 2/2011 |
| JP | 5296915 | B1 | 6/2013 |
| WO | WO2004/062039 | A1 | 7/2004 |

* cited by examiner

ELECTRICAL CONNECTOR

BACKGROUND OF THE INVENTION

1. Field of the Invention

The present invention relates to an electrical connector that contacts and becomes conductively connected to a connection object, such as an electrical connector, a board, or a flat cable.

2. Description of the Related Art

As the performance and multifunctionality of automobile electronic appliances and consumer electronic appliances have increased, electrical connectors for connecting printed circuit boards (hereinafter, referred to as "boards") to each other are increasingly used. Moreover, as electronic appliances have been reduced in size, boards have also been reduced in size and component packing density has increased. At the same time, as the types of data processing operations have increased with increasing performance and multifunctionality of electronic appliances, the number of terminals of connectors has been increasing (see Japanese Unexamined Patent Application Publication No. 2011-40206).

However, as the number of terminals of a connector increases, a greater force is needed to fit the connector into another connector, and the connectors become fitted to each other more tightly. This increases the burden on an operator. Moreover, if it is necessary for an operator to apply a greater force to connect the connectors, the operator may misunderstand that the connectors have been connected when the operator feels a strong resistance with his/her hand and may stop the operation in a semi-fitted state. If the operator twists the connectors to forcibly fit the connectors with each other, the connectors may become obliquely fitted or the terminals may become buckled.

SUMMARY OF THE INVENTION

An object of the present invention is to provide an electrical connector that can reduce a resistance that an operator feels with his/her hand when terminals of the electrical connector become fitted with a connection object and that can improve the insertability. Another object of the present invention is to provide an electrical connector that can make a rear contact-point portion to securely contact a connection object and that has high reliability.

To achieve these objects, the present invention provides an electrical connector structured as follows. An electrical connector includes a housing, and a plurality of terminals fixed to the housing. The housing includes a fixed housing fixed to a board, and a movable housing that is displaceable relative to the fixed housing. Each of the terminals includes a board connection portion fixed to the housing; a base fixed to the movable housing; a terminal portion that, in the movable housing, contacts and becomes conductively connected to a conductive connection portion of a connection object inserted into the movable housing; and a movable portion that is connected to the board connection portion at one end portion thereof and connected to the base at the other end portion thereof and that elastically supports the movable housing in such a way that the movable housing is displaceable relative to the fixed housing. The terminal portion includes a front terminal portion and a rear terminal portion. The front terminal portion includes a front contact-point portion and an elastic piece, the front contact-point portion slidably contacting the conductive connection portion of the connection object when the connection object is inserted into the movable housing and wiping off a foreign substance adhering to the conductive connection portion, the elastic piece supporting the front contact-point portion so as to be elastically displaceable. The rear terminal portion includes a rear contact-point portion and an elastic piece. The rear contact-point portion sliding along a sliding path of the front contact-point portion in an insertion direction in which the connection object is inserted into the movable housing and conductively contacting the conductive connection portion from which the foreign substance has been wiped off by the front contact-point portion, and the elastic piece supporting the rear contact-point portion so as to be elastically displaceable. The front contact-point portion and the elastic piece of the front-contact portion, and the rear contact-point portion and the elastic piece of the rear contact-point portion are each formed so as to maintain a plate surface of a flat metal plate. Positions of the front contact-point portions that are adjacent to each other are displaced from each other so that the front contact-point portions contact the connection object at different positions in the insertion direction. Positions of the rear contact-point portions that are adjacent to each other are displaced from each other so that the rear contact-point portions contact the connection object at different positions in the insertion direction. The base and the movable portion are connected to each other in the fixed housing and are arranged side by side in the fixed housing in such a way that the base and the movable portion extend in the insertion direction.

In a case where each terminal includes a plurality of contact-point portions, such as a front contact-point portion and a rear contact-point portion, an operator first causes a connection object to contact the front contact-point portion and causes the connection object to pass over the front contact-point portion by more strongly pressing the connection object into the electrical connector. Next, the operator causes the connection object to contact the rear contact-point portion and causes the connection object to pass over the rear contact-point portion by more strongly pressing the connection object. In this case, the operator feels a resistance with his/her hand when the connection object contacts and passes over each of the contact-point portions. The resistance increases as the number of contact points that simultaneously contact the connection object increases. When receiving a resistance due to contact between the rear contact-point portion and the connection object, the operator may misunderstand that the connection object has reached the deepest position at which the electrical connectors are fitted with each other and may stop inserting the connection object in a semi-fitted state. Moreover, if the operator tries to forcibly and clumsily insert the connection object into the electrical connector with a large force against the resistance to his/her hand, the connection object may become obliquely fitted into the electrical connector or the electrical connector may become buckled. In particular, the operator feels a stronger resistance in a case where the front contact-point portion and the elastic piece of the front contact-point portion, and rear contact-point portion and the elastic piece of the rear contact-point portion are each made by a flat metal plate to maintain the shape of a plate surface of the flat metal plate and the connection object contacts an edge of each of the contact-point portions and the elastic pieces. Accordingly, oblique fitting and buckling are more likely to occur in this case.

Therefore, in the present invention, the positions of the front contact-point portions that are adjacent to each other and the positions of adjacent the rear contact-point portions that are adjacent to each other are respectively displaced from each other so that the rear contact-point portions contact the connection object at different positions in the insertion direction. Thus, the number of the rear contact-point portions that simultaneously contact the connection object can be reduced and the insertion force can be dispersed, and therefore the insertability can be improved. Accordingly, occurrence damage to the terminal due to imperfect fitting, such as semi-fitting and oblique fitting described above, and due to buckling can be reduced.

The electrical connector according to the present invention has a floating function that is performed by the movable portion, which is connected to the board connection portion at one end portion thereof and connected to the base at the other end portion thereof and which elastically supports the movable housing in such a way that the movable housing is displaceable relative to the fixed housing.

Moreover, according to the present invention, the front contact-point portion slidably contacts the conductively contact portion of the connection object, and the rear contact-point portion slides along a sliding path of the front contact-point portion in an insertion direction in which the connection object is inserted into the movable housing and conductively contacts the conductive connection portion from which the foreign substance has been wiped off by the front contact-point portion. Therefore, the rear contact-point portion can conductively contact the connection object stably without foreign substances interposed therebetween, and the contact reliability can be increased.

Furthermore, according to the present invention, the base and the movable portion are connected to each other in the fixed housing and are arranged side by side in the fixed housing in such a way that the base and the movable portion extend in the insertion direction. Accordingly, the size of the electrical connector having the floating function can be reduced in the transverse direction of the electrical connector perpendicular to the direction in which the terminals are arranged at a pitch.

In the electrical connector, a contact pressure with which the rear contact-point portion of the rear terminal portion contacts the connection object may be higher than a contact pressure with which the front contact-point portion of the front terminal portion contacts the connection object.

In this case, the rear contact-point portion, which is located deeper in the insertion direction of the connection object than the front contact-point portion, can securely contact the connection object.

With the electrical connector according to the present invention, a resistance that an operator feels with his/her hand can be reduced and the insertability can be improved while realizing a function of wiping off foreign substances adhering to a connection object, a floating function, and reduction in the size of an electrical connector in the transverse direction. Thus, occurrence of imperfect fitting, such as semi-fitting and oblique fitting, can be suppressed. Moreover, damage to a terminal due to buckling or the like can be suppressed. Accordingly, with the electrical connector according to the present invention, the rear contact-point portion can securely contact a connection object and therefore an electrical connector having high reliability can provided.

DESCRIPTION OF THE PREFERRED EMBODIMENTS

Hereinafter, an embodiment of an electrical connector according to the present invention will be described with reference to the drawings. In the embodiment below, an example of an interboard connector having a floating function will be described.

Figure 1:
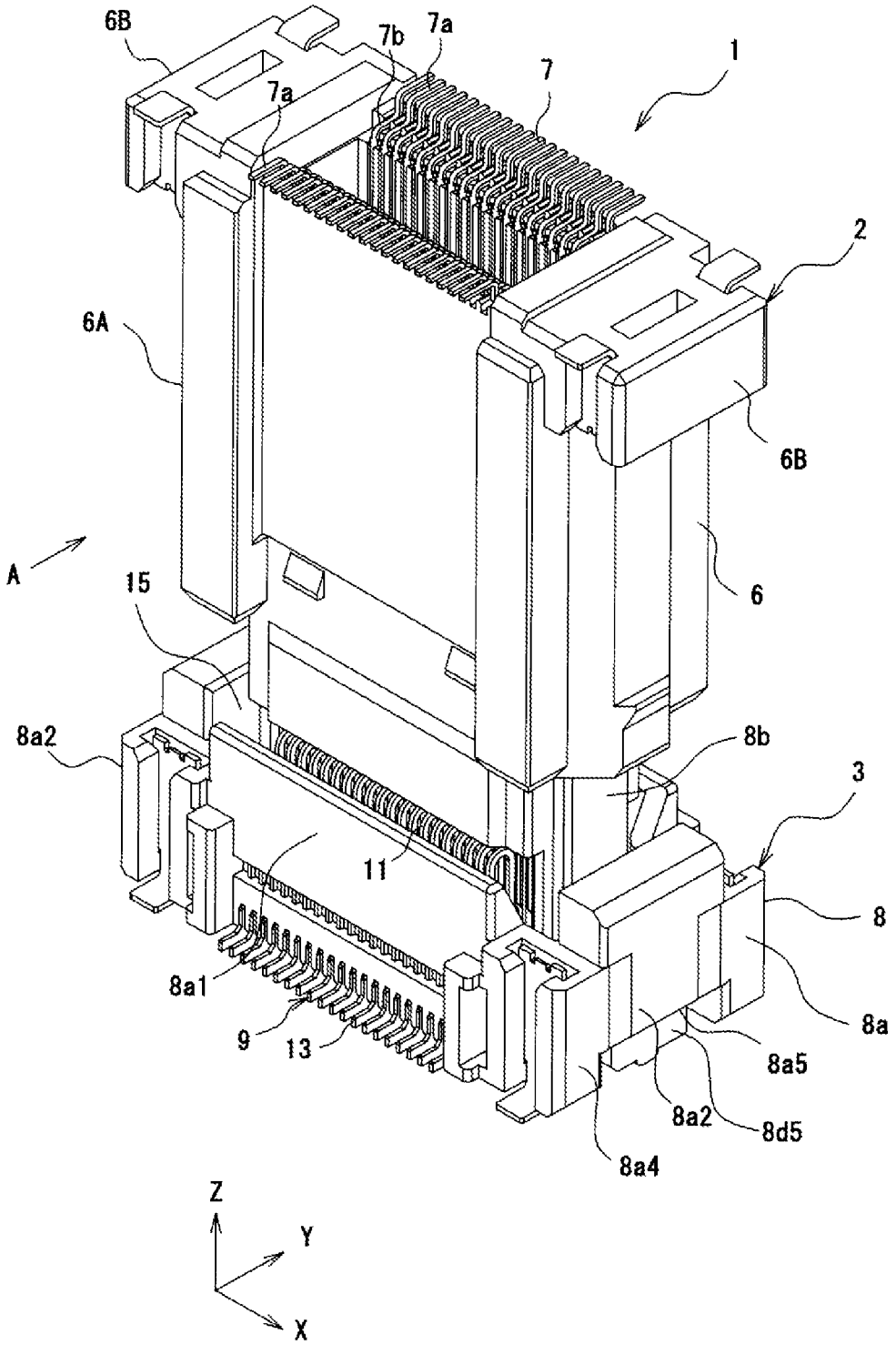
FIG. 1 is a perspective view of an electrical connector according to an embodiment.
Figure 2:
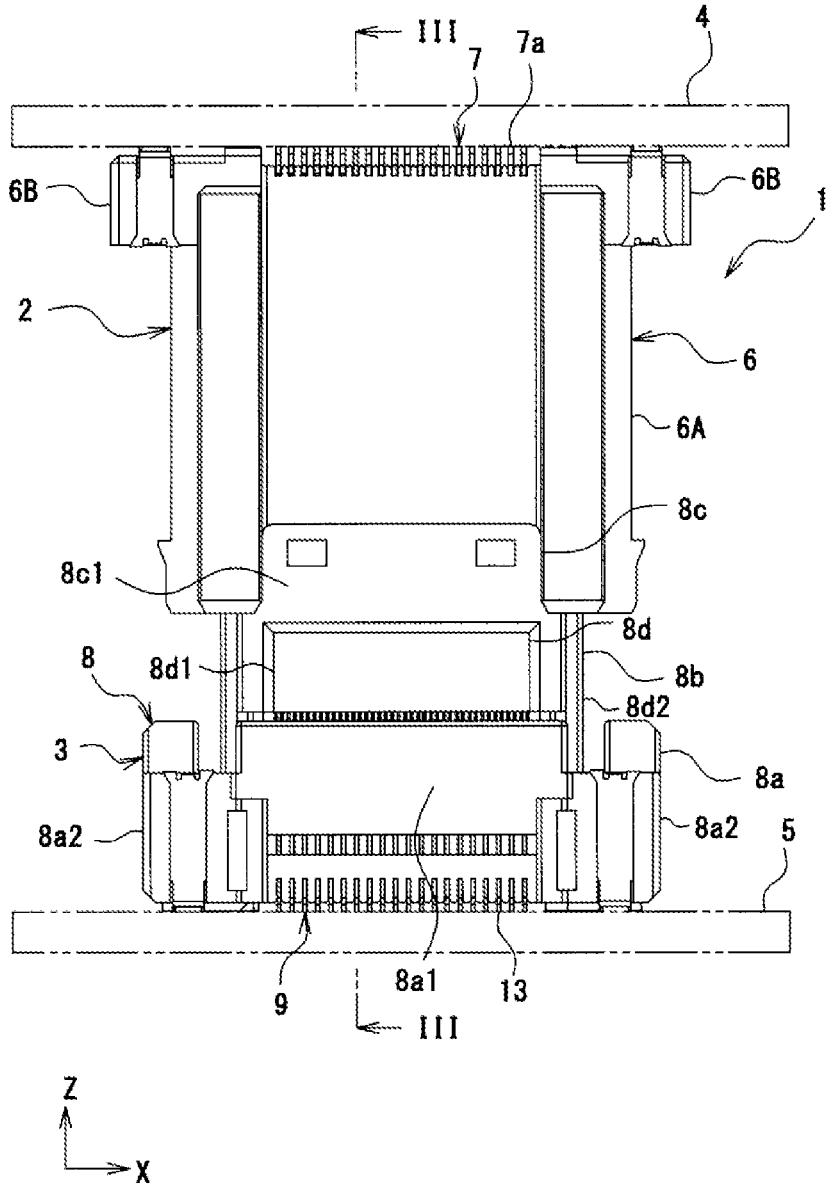
FIG. 2 is a front view of the electrical connector seen in the direction of an arrow A in FIG. 1.

As illustrated in FIGS. 1 and 2, an electrical connector 1 includes a plug connector 2 and a socket connector 3. As illustrated in FIGS. 2 to 5, the plug connector 2 is mounted on a board 4, and the socket connector 3 is mounted on a board 5. When the plug connector 2 is fitted into the socket connector 3, the board 4 and the board 5 become conductively connected to each other.

As illustrated in FIGS. 1 to 13, in the specification, claims, and the drawings, the longitudinal direction of the electrical connector 1 will be referred to as the X direction, the transverse direction of the electrical connector 1 will be referred to as the Y direction, and the insertion/extraction direction in which the plug connector 2 is inserted into/extracted from the socket connector 3 will be referred to as the Z direction. The plug connector 2 side in the insertion/extraction direction Z will be referred to as the "upper side", and the socket connector 3 side in the insertion/extraction direction Z will be referred to as the "lower side".

Plug Connector

Figure 3:
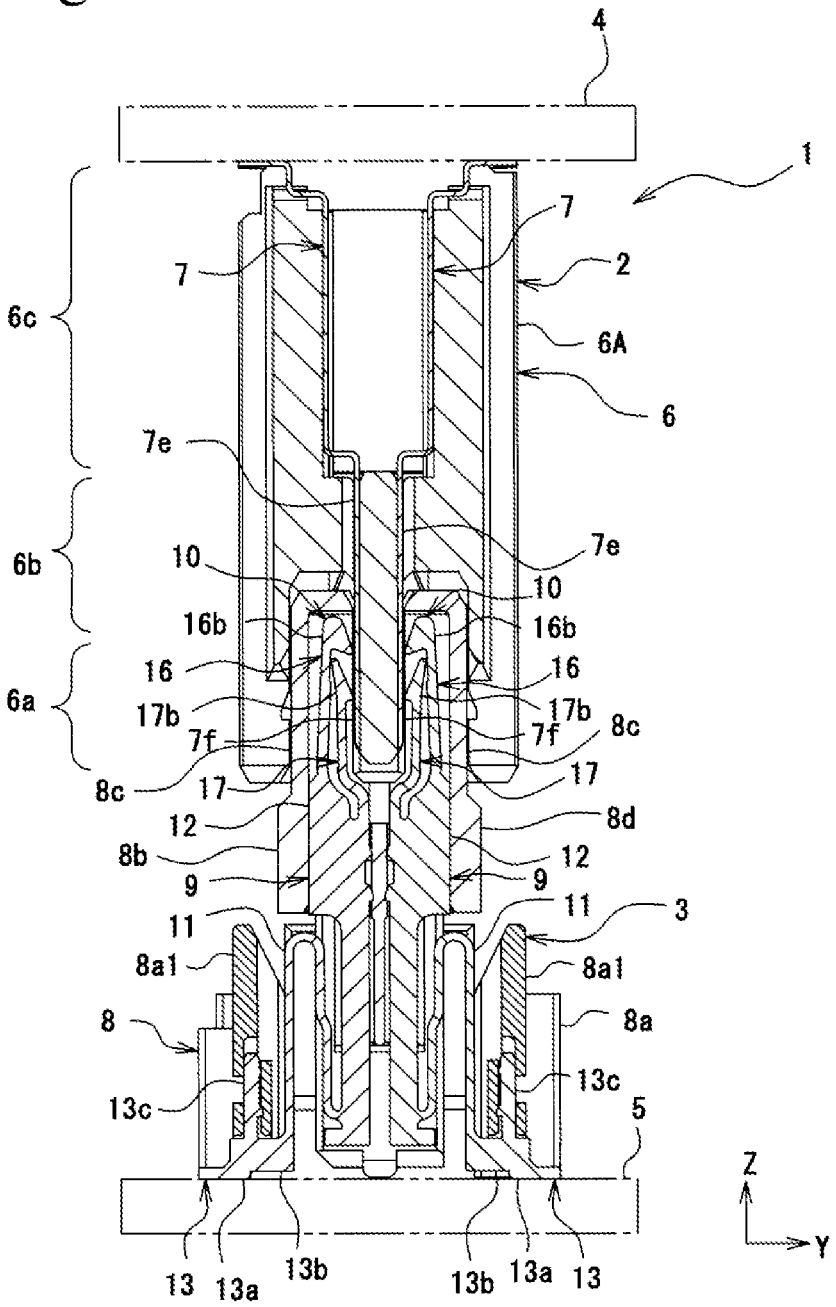
FIG. 3 is a sectional view of the electrical connector taken along line III-III in FIG. 2.
Figure 4:
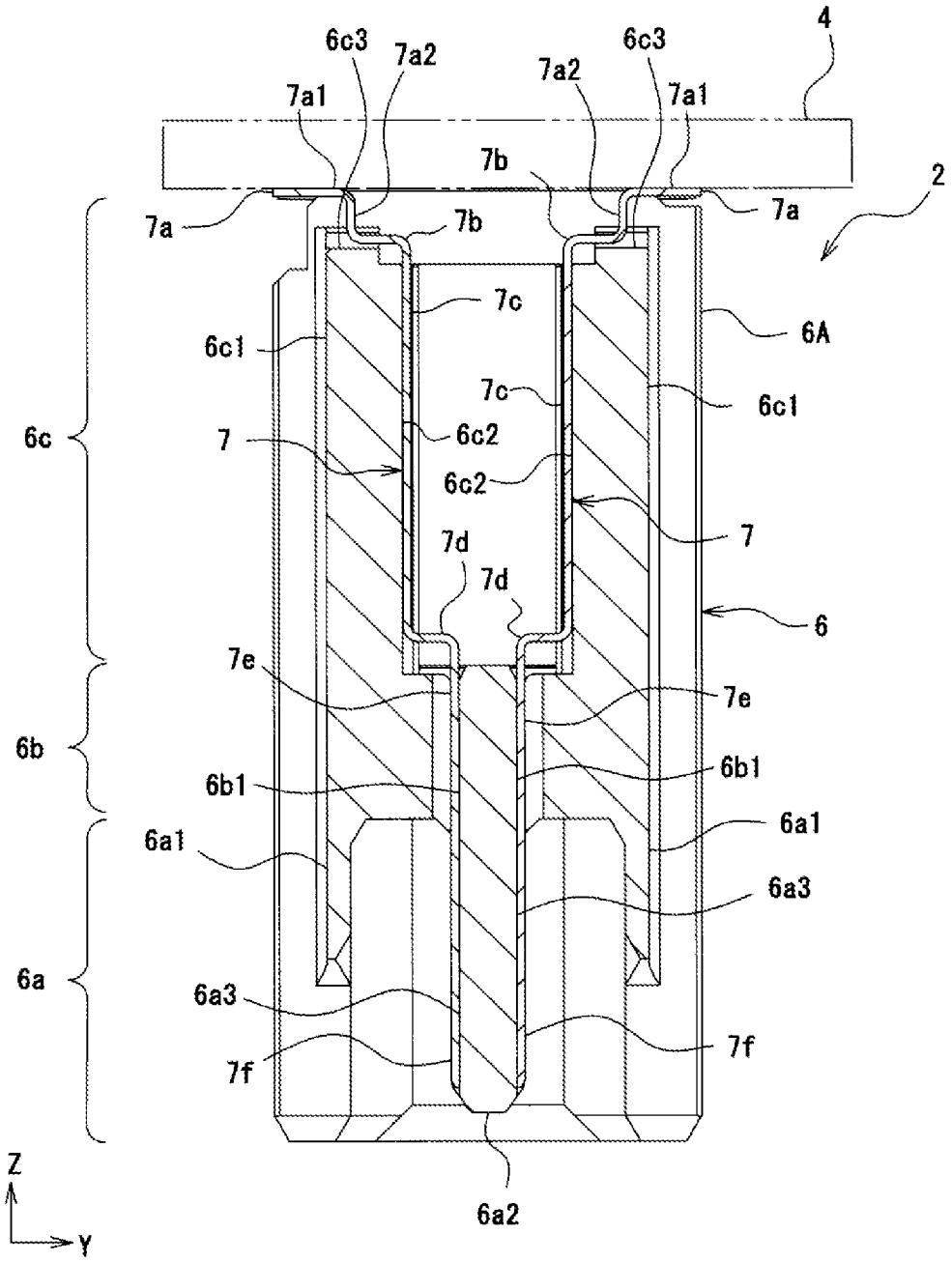
FIG. 4 is a sectional view of a plug connector illustrated in FIG. 3.

As illustrated in FIGS. 3 and 4, the plug connector 2 includes a plug housing 6 and plug terminals 7.

Plug Housing

The plug housing 6 is made of an insulating resin and includes a body 6A and legs 6B. The legs 6B are disposed on both sides of the body 6A in the longitudinal direction X of the body 6A and are fixed to the board 4.

The body 6A includes a fitting portion 6*a*, a separation wall portion 6*b*, and a base 6*c*. The fitting portion 6*a* allows the socket connector 3 to be inserted thereinto when the electrical connector 1 becomes connected. The separation wall portion 6*b* separates the fitting portion 6*a* from the base 6*c*. In a connected state, the base 6*c* is located near the board 4.

Side walls 6*a*1, which extend in the longitudinal direction X, are disposed on both sides of the fitting portion 6*a* in the transverse direction Y (see FIG. 4). A center wall 6*a*2, which extends in the longitudinal direction X, is disposed between the side walls 6*a*1. Attachment grooves 6*a*3 are formed in the center wall 6*a*2 so as to be arranged side by side in the longitudinal direction X. Each of the plug terminals 7 is pressed into and held by a corresponding one of the attachment grooves 6*a*3.

Attachment holes 6*b*1, which are continuous with the attachment grooves 6*a*3, are formed in the separation wall portion 6*b*. Each of the plug terminals 7 is inserted into and held by a corresponding one of the attachment holes 6*b*1.

Side walls 6*c*1, which extend in the longitudinal direction X, are disposed on both sides of the base 6*c* in the transverse direction Y (see FIG. 4). Attachment grooves 6*c*2, which are continuous with the attachment grooves 6*a*3 and the attachment holes 6*b*1, are formed in inner surfaces of the side walls 6*c*1. The plug terminals 7 are held by the attachment grooves 6*a*3, the attachment holes 6*b*1, and the attachment groove 6*c*2, which serve as a terminal attachment portion of the plug housing 6. The base 6*c* includes bottom portions 6*c*3, which face the board 4. The bottom portions 6*c*3 are recessed so as to be separated from a board surface of the board 4 when the legs 6B of the plug housing 6 are fixed to the board 4. The plug terminals 7 are exposed from the bottom portions 6*c*3 and fixed to the board 4.

Plug Terminal

The plug terminals 7 are made by press-punching and bending a flat metal plate. As illustrated in FIG. 4, each of the plug terminals 7 includes a board connection portion 7*a*, a first separation portion 7*b*, a linear portion 7*c*, a second separation portion 7*d*, an insertion portion 7*e*, and a contact portion 7*f*.

The board connection portion 7*a* includes a connection portion 7*a*1 and a support portion 7*a*2. The connection portion 7*a*1, which extends parallel to the board surface, is soldered to the board 4. The support portion 7*a*2, which is continuous with an end of the connection portion 7*a*1, is bent so as to extend perpendicularly from the board surface.

The first separation portion 7*b* is bent so as to extend from an end of the support portion 7*a*2 parallelly to the board surface. The first separation portion 7*b* is separated from the bottom portion 6*c*3 of the plug housing 6 so that a gap is formed between the first separation portion 7*b* and the bottom portion 6*c*3. As described below, the gap serves to suppress flowing of flux due to capillary action.

The linear portion 7*c*, which corresponds to a "fixed portion", extends in the insertion/extraction direction Z of the plug connector 2 and is fixed to the inside of a corresponding one of the attachment grooves 6*c*2 of the base 6*c* of the plug housing 6.

The second separation portion 7*d* extends from an end of the linear portion 7*c* in a crank shape so as not to be in contact with inner walls of the base 6*c* and the separation wall portion 6*b*. The second separation portion 7*d* is separated from the inner walls of the base 6*c* and the separation wall portion 6*b* so that a gap is formed between the second separation portion 7*d* and the inner walls. As in the case of the first separation portion 7*b*, the gap serves to suppress flowing of flux due to capillary action.

The insertion portion 7*e* is inserted into and held by a corresponding one of the attachment holes 6*b*1 of the separation wall portion 6*b* of the plug housing 6.

The contact portion 7*f*, which is to be conductively connected to a corresponding one of socket terminals 9, is disposed in a corresponding one of the attachment grooves 6*a*3 of the center wall 6*a*2 of the fitting portion 6*a*.

Socket Connector

Figure 5:
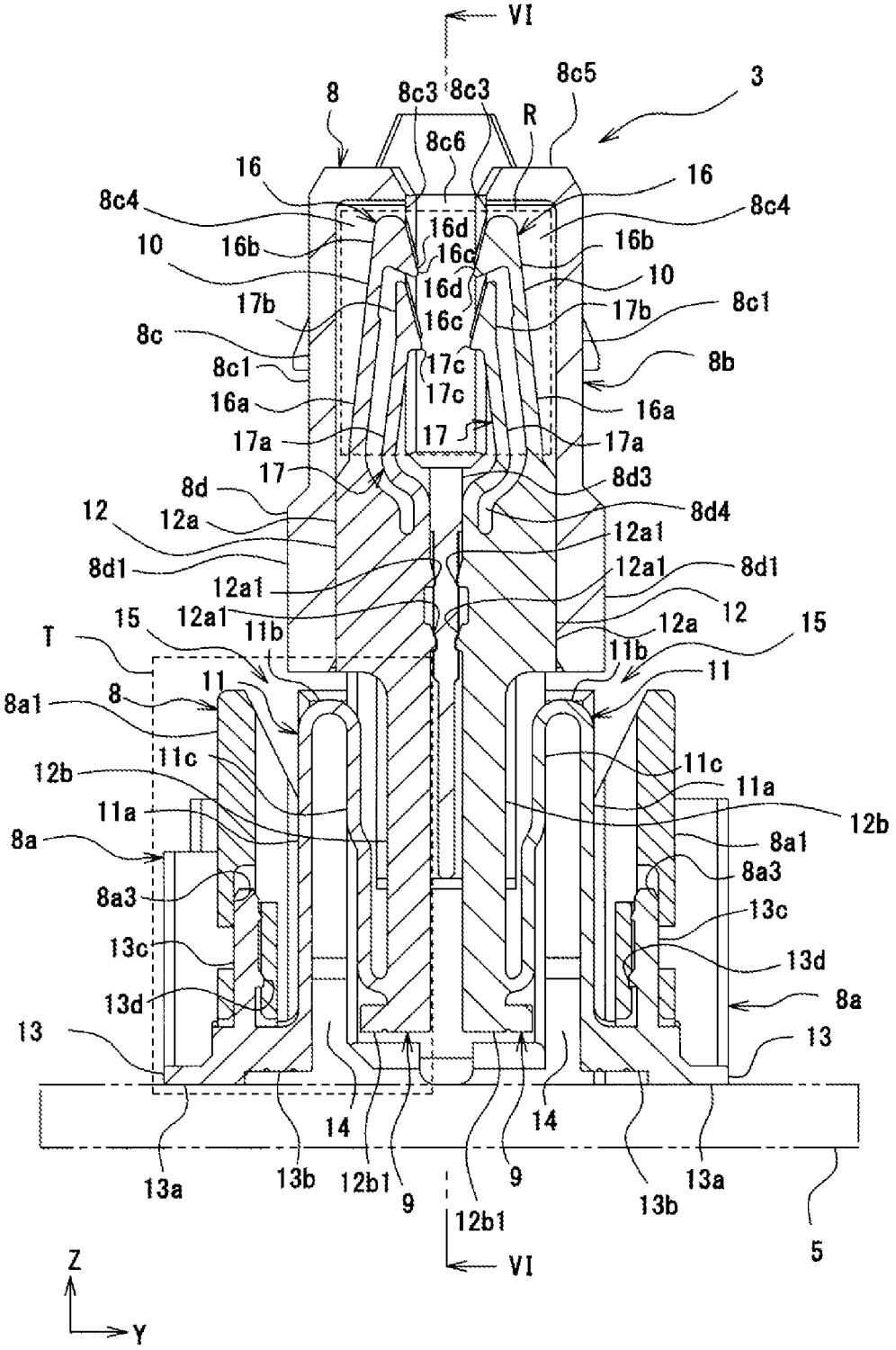
FIG. 5 is a sectional view of a socket connector illustrated in FIG. 3.

As illustrated in FIGS. 3 and 5, the socket connector 3 includes a socket housing 8 and the socket terminal 9.

Socket Housing

The socket housing 8 includes a fixed housing 8*a* and a movable housing 8*b*.

Movable Housing

The movable housing 8*b*, which has a structure as described below, includes a fitting portion 8*c* and a terminal holding portion 8*d*, which are arranged in this order in a direction from which the plug connector 2 is inserted. The plug housing 6 is fitted into the fitting portion 8*c*. The terminal holding portion 8*d* holds the socket terminals 9.

Long-side walls 8*c*1, which extend in the longitudinal direction X of the movable housing 8*b*, are disposed on both sides of the fitting portion 8*c* in the transverse direction Y. Short-side walls 8*c*2, which extend in the transverse direction Y, are disposed on both sides of the fitting portion 8*c* in the longitudinal direction X. Long inner walls 8*c*3, each of which faces a corresponding one of the long-side walls 8*c*1, are disposed in the fitting portion 8*c*. Partition walls 8*c*4, each of which insulates adjacent socket terminals 9 from each other, are disposed between the long-side walls 8*c*1 and the long inner walls 8*c*3 (see FIG. 5). A front wall 8*c*5 is formed at an end of the fitting portion 8*c* on the fitting side.

A space between the long inner walls 8*c*3, which face each other, is a plug insertion portion 8*c*6 into which the center wall 6*a*2 of the plug housing 6 is inserted (see FIG. 5).

The socket terminals 9 are disposed in containing portions, which are inner spaces defined by the long-side walls 8*c*1, the short-side walls 8*c*2, the long inner walls 8*c*3, the partition walls 8*c*4, and the front wall 8*c*5. In the fitting portion 8*c* according to the present embodiment, the containing portions are formed on both sides of the plug insertion portion 8*c*6.

The terminal holding portion 8*d* includes long-side walls 8*d*1 and short-side walls 8*d*2, which are respectively continuous with the long-side walls 8*c*1 and the short-side walls 8*c*2 of the fitting portion 8*c*. The long-side walls 8*d*1 protrude outward and each has a thickness smaller than that of each of the long-side walls 8*c*1 of the fitting portion 8*c*. The terminal holding portion 8*d* further includes a center wall 8*d*3 disposed between the long-side walls 8*d*1. The center wall 8*d*3 extends from the plug insertion portion 8*c*6. The center wall 8*d*3 extends in the insertion/extraction direction Z beyond the lower ends of the long-side walls 8*d*1 toward the board 5.

Partition walls 8*d*4, each of which is continuous with a corresponding one of the partition walls 8*c*4 of the fitting portion 8*c*, are formed between the long-side walls 8*d*1 and the center wall 8*d*3 (see FIG. 5). Thus, adjacent socket terminals 9 are structurally insulated from each other. According to the present embodiment, on the long-side wall 8*d*1 side of the movable housing 8*b*, the position of the lower end of the partition wall 8*d*4 coincides with the position of the lower end of the long-side wall 8*d*1; on the center wall 8*d*3 side, the positon of the lower end of the partition wall 8*d*4 coincides with the position of the lower end of the center wall 8*d*3.

The socket terminals 9 are disposed in containing portions, which are inner spaces defined by the long-side walls 8*d*1, the short-side walls 8*d*2, the center wall 8*d*3, and the partition walls 8*d*4. The term "terminal attachment grooves" refer to slit-like grooves formed by the containing portions of the terminal holding portion 8*d* and the containing portions of the fitting portion 8*c*. Each of the socket terminals 9 is inserted into and fixed to a corresponding one of the terminal attachment grooves.

As described above, each of the long-side walls 8*d*1 of the terminal holding portion 8*d* is formed so as to have a thickness smaller than that of each of the long-side walls 8*c*1 of the fitting portion 8*c*. One reason for this is increase the rigidity of the terminal holding portion 8*d* and to enable the terminal holding portion 8*d* to securely hold the socket terminal 9 when the socket terminal 9 is pressed into the terminal holding portion 8*d*. Another reason for this is to make the long-side walls 8*d*1 extend over a movable portion 11 of the socket terminal 9 and to enable the terminal holding portion 8*d* to function as a "protective wall" that protects the upper side of the movable portion 11 from a contact or an impact from the outside. In consideration of the function as a protective wall, as illustrated in FIG. 5, the long-side wall 8*d*1 has a thickness that allows the long-side wall 8*d*1 to extend over and beyond a first extension 11*a* of the movable portion 11 in the transverse direction Y when the long-side wall 8*d*1 is at rest and is not relatively displaced.

Figure 6:
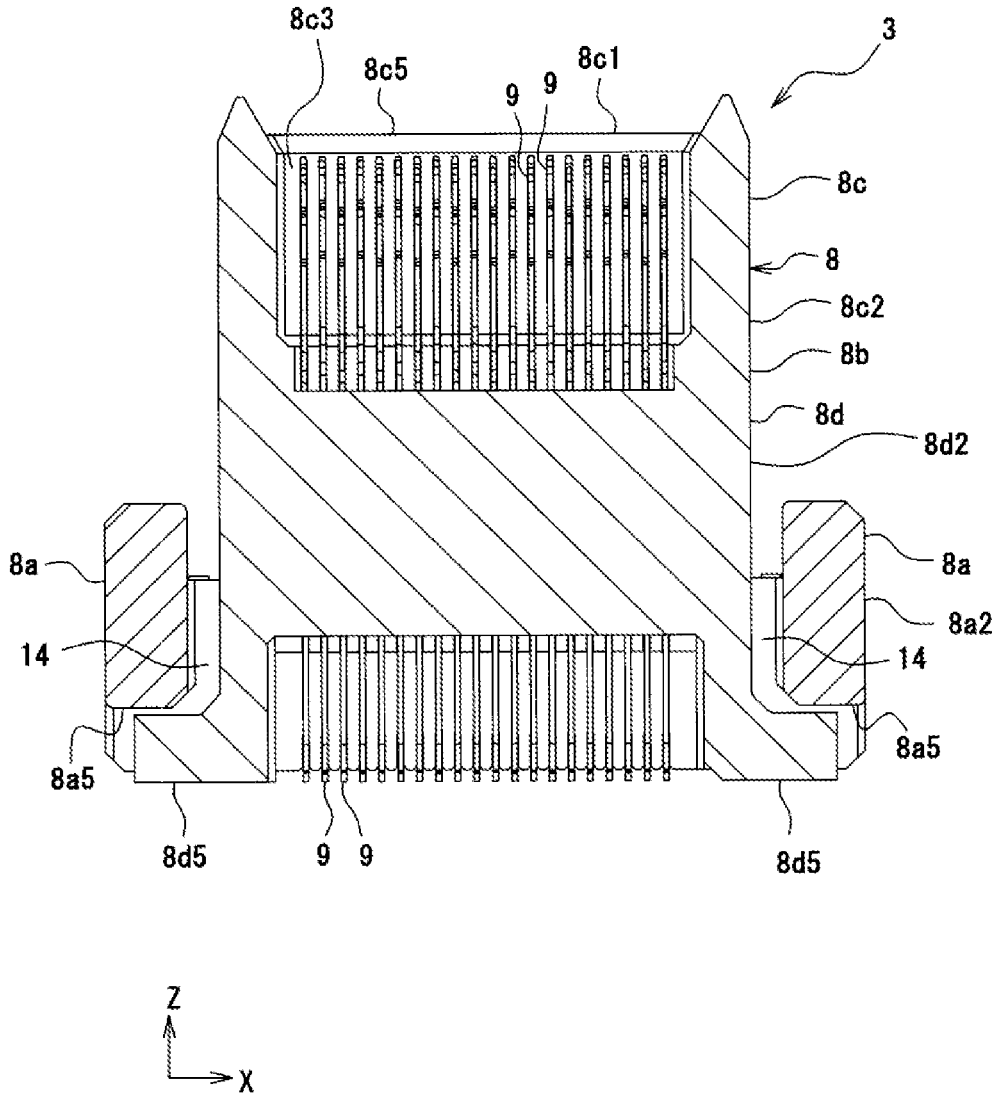
FIG. 6 is a sectional view of the socket connector taken along line VI-VI in FIG. 5.

As illustrated in FIG. 6, the short-side wall 8*d*2 of the terminal holding portion 8*d* includes engagement portions 8*d*5 extending toward the board 5 and bent outward so as to be parallel to the board surface. As described below, the engagement portions 8*d*5 function as a stopper for restricting excessive displacement of the movable housing 8*b* relative to the fixed housing 8*a*.

Fixed Housing

The fixed housing 8*a* is disposed so as to surround the outer periphery of a lower part of the movable housing 8*b*. The fixed housing 8*a* has long-side walls 8*a*1 and short-side wall 8*a*2. The long-side walls 8*a*1, which extend in the longitudinal direction X, are disposed on both sides of the fixed housing 8*a*. The short-side walls 8*a*2, which extend in the transverse direction Y, are disposed at both ends of the long-side walls 8*a*1. Fixing holes 8*a*3, to which the socket terminal 9 are fixed, are formed in the long-side walls 8*a*1. Each of the short-side walls 8*a*2 includes legs 8*a*4 and an engagement receiving portion 8*a*5. The legs 8*a*4 are fixed to the board 5. The engagement portions 8*d*5 described above, which function as a stopper of the movable housing 8*b*, become engaged with the engagement receiving portions 8*a*5, each of which is shaped like a hole, in the extraction direction of the insertion/extraction direction Z.

A movable space 14, in which the socket terminal 9 and the movable housing 8*b* are movable, is formed in the fixed housing 8*a* having the structure describe above. Structural elements of the movable housing 8*b* located in the movable space 14 are the center wall 8*d*3 and the partition walls 8*d*4 of the terminal holding portion 8*d*. The widths of the center wall 8*d*3 and the partition walls 8*d*4 are smaller than the distance between the outer surfaces of the pair of long-side walls 8*d*1 in the transverse direction Y. Accordingly, the width of the space occupied by the movable housing 8*b* in the fixed housing 8*a* in the transverse direction Y can be reduced and the volume of the movable space 14 can be increased.

An opening 15 is formed between an upper end of each of the long-side walls 8*a*1 of the fixed housing 8*a* and a lower end of a corresponding one of the long-side walls 8*d*1 of the movable housing 8*b*. The lower end of each of the long-side walls 8*d*1 of the movable housing 8*b* are not located inside the fixed housing 8*a* but is located diagonally above the upper end of a corresponding one of the long-side walls 8*a*1. Thus, the openings 15 each having a large size are formed, and therefore heat generated on the board 5 and accumulated in the fixed housing 8*a* can be released to the outside through the openings 15.

Socket Terminal

The socket terminals 9 are made by press-punching a flat metal plate and performing a predetermined finishing operation, such as chamfering, on the punched metal plate. The socket terminals 9 are so-called "punched terminals", which maintain the shape of a flat metal plate and which are not bent in the thickness direction. The socket terminals 9 are disposed in such a way that the plate surfaces thereof extend in the transverse direction Y of the socket housing 8 and each pair of the socket terminals 9 face each other. As illustrated in FIGS. 3 and 5, each of the socket terminals 9 includes a terminal portion 10, a base 12, the movable portion 11, and a board connection portion 13, which are disposed in this order from the direction from which the plug connector 2 is inserted.

The socket terminals 9 are arranged side by side at a regular pitch in the longitudinal direction X of the socket housing 8. By forming each of the socket terminals 9 in a flat plate-like shape so as not to be bent in the thickness direction, the width of the socket terminal 9 in the longitudinal direction X can be reduced. Therefore, the socket terminals 9 can be arranged at a small pitch, and the size of the electrical connector 1 in the longitudinal direction X can be reduced. As a result, the size of the electrical connector 1 according to the present embodiment can be reduced also in the transverse direction Y as described below.

Board Connection Portion

Each of the board connection portions 13 includes a connection portion 13*a*, a support portion 13*b*, and a fixing piece 13*c*. The connection portion 13*a* protrudes outward from the fixed housing 8*a* and is soldered to the board 5. The support portions 13*b* are disposed on the upper side of the connection portion 13*a* and support the socket housing 8 at a position above the board surface of the board 5. When the board connection portions 13 have been soldered, a gap is formed between the support portion 13*b* and the board 5. The fixing piece 13*c* is formed on each of the support portion 13*b* so as to protrude in the insertion/extraction direction Z. When engagement protrusions 13*d* of the fixing pieces 13*c* engage with inner walls of the fixing holes 8*a*3 of the fixed housing 8*a*, the socket terminals 9 are fixed to the fixed housing 8*a*.

Movable Portion

The movable portion 11 is a strip-shaped elastic member that is inversely U-shaped. The movable portion includes the first extension 11*a*, a hairpin portion 11*b*, and a second extension 11*c*. The first extension 11*a*, the second extension 11*c*, and a lower portion 12*b* of the base 12 (described below) are disposed side by side. The movable portion 11 is located in the movable space 14 in the fixed housing 8*a* and elastically supports the movable housing 8*b* so as to be movable relative to the fixed housing 8*a*.

By providing the movable portion 11, for example, when the electrical connector 1 is vibrated or when the plug connector 2 is being fitted into the socket connector 3, the movable portion 11 becomes displaced in the movable space 14 and the movable housing 8*b* can be displaced relative to the fixed housing 8*a*.

The first extension 11*a* extends in the insertion/extraction direction Z from an end of the board connection portion 13 in the horizontal direction. The first extension 11*a* is separated from the board connection portion 13 with a gap-forming portion 14*c* interposed between the first extension 11*a* and an inner surface 8*a*6 of the fixed housing 8*a* (see FIG. 10). Thus, even if flux flows up along the board connection portion 13 and reaches the movable portion 11, because the gap-forming portion 14*c* is present near the boundary between the movable portion 11 and the board connection portion 13 and the movable portion 11 is separated from the inner surface 8*a*6, flowing up of flux due to capillary action, which might occur if the first extension 11*a* were in contact the inner surface 8*a*6, can be suppressed. The hairpin portion 11*b* is disposed at the upper end of the first extension 11*a* so as to be continuous with the second extension 11*c*.

Figure 10:
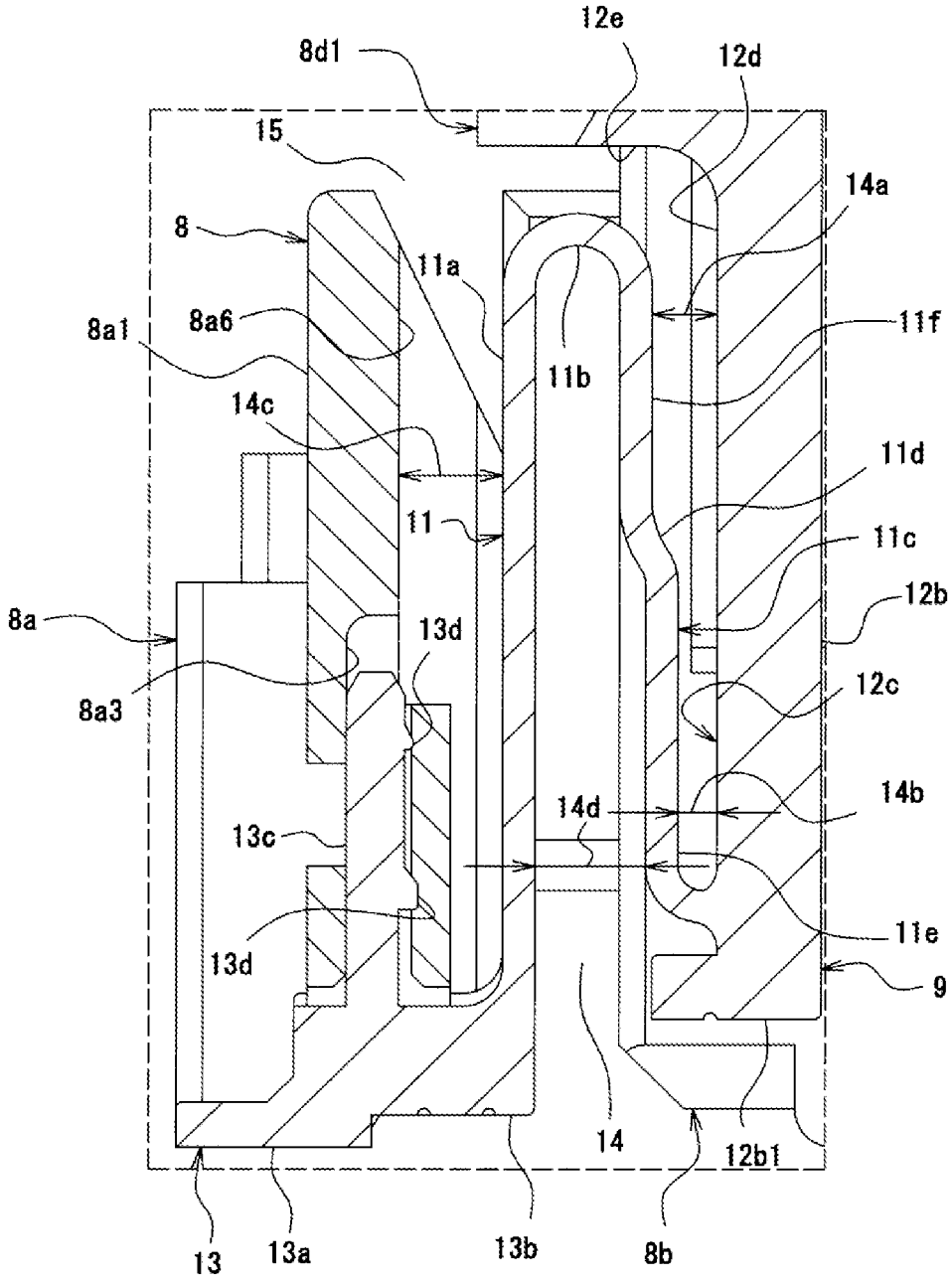
FIG. 10 is an enlarged view of a region T in FIG. 5.
Figure 11:
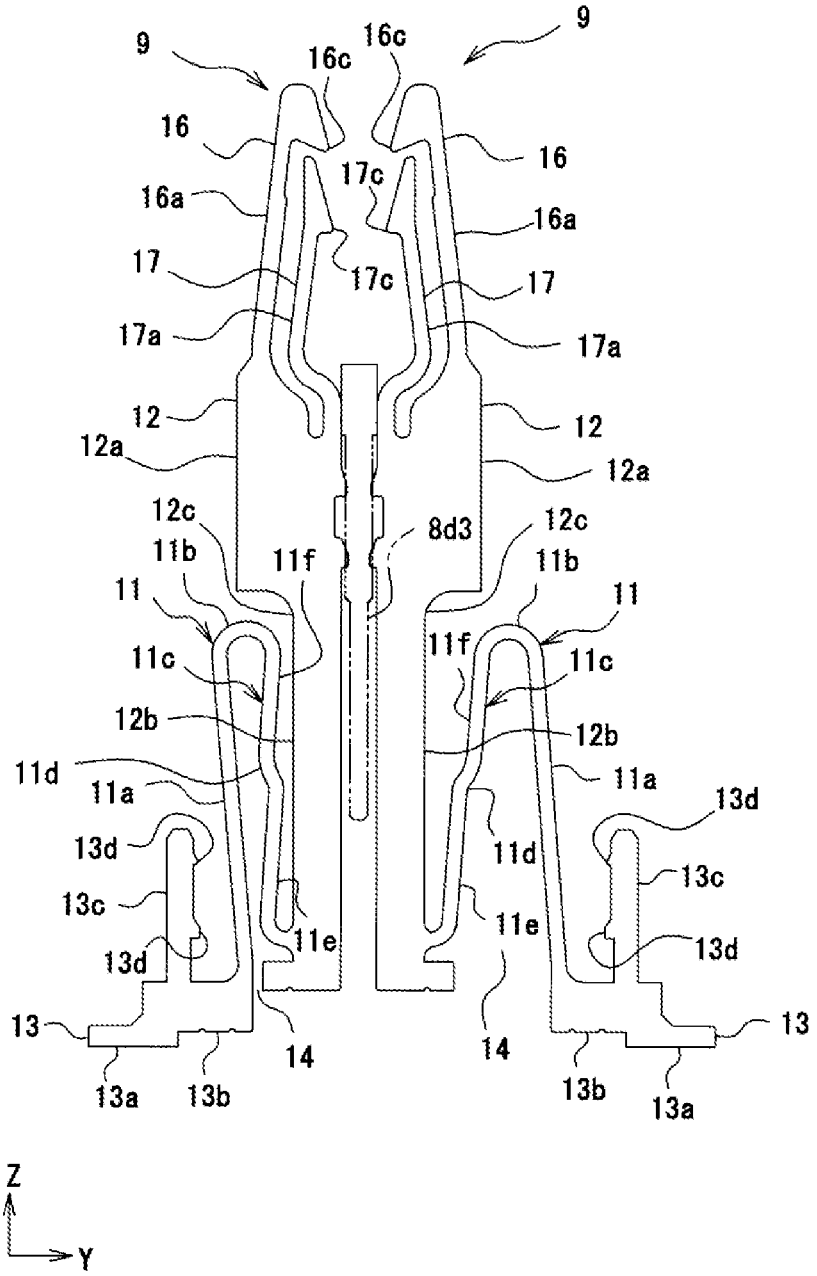
FIG. 11 illustrates a socket terminal of FIG. 3 in a displaced state.
Figure 12:
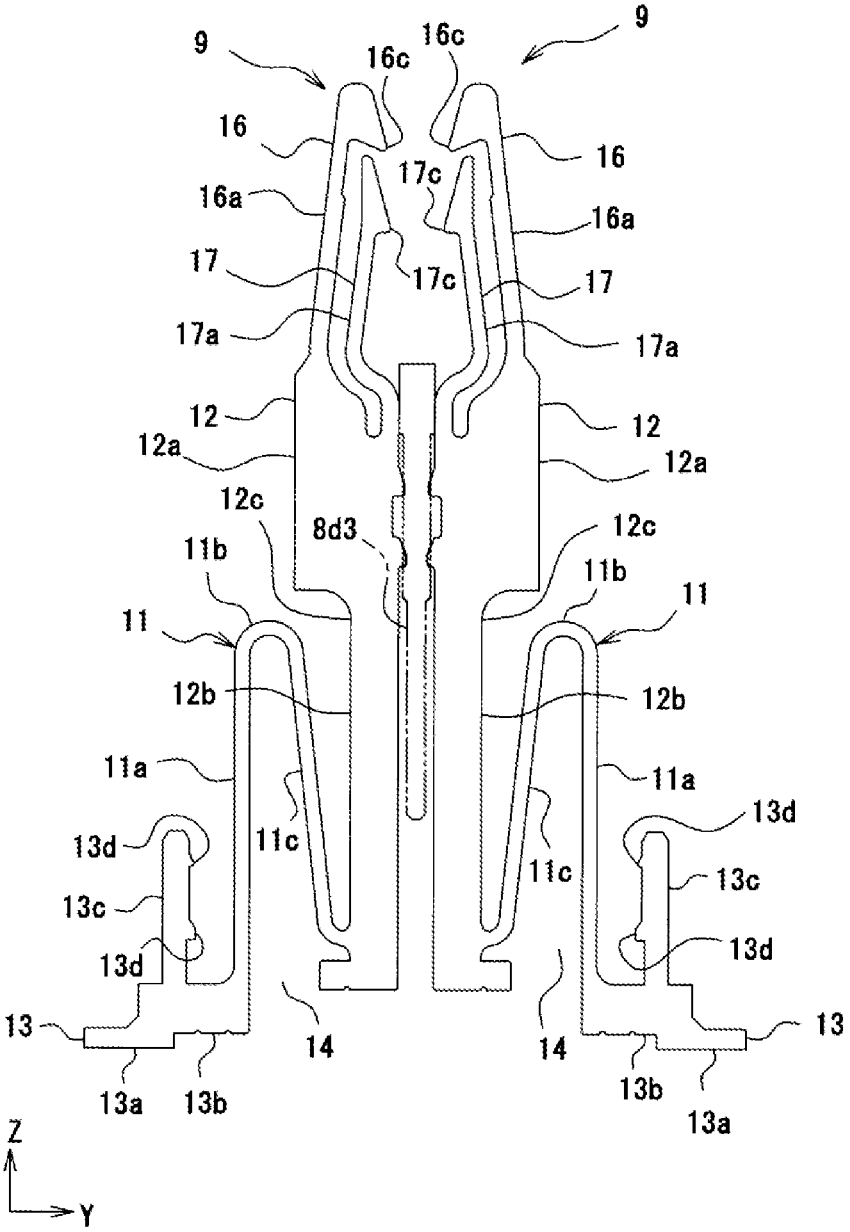
FIG. 12 is a front view of a socket terminal according to a modification.
Figure 13:
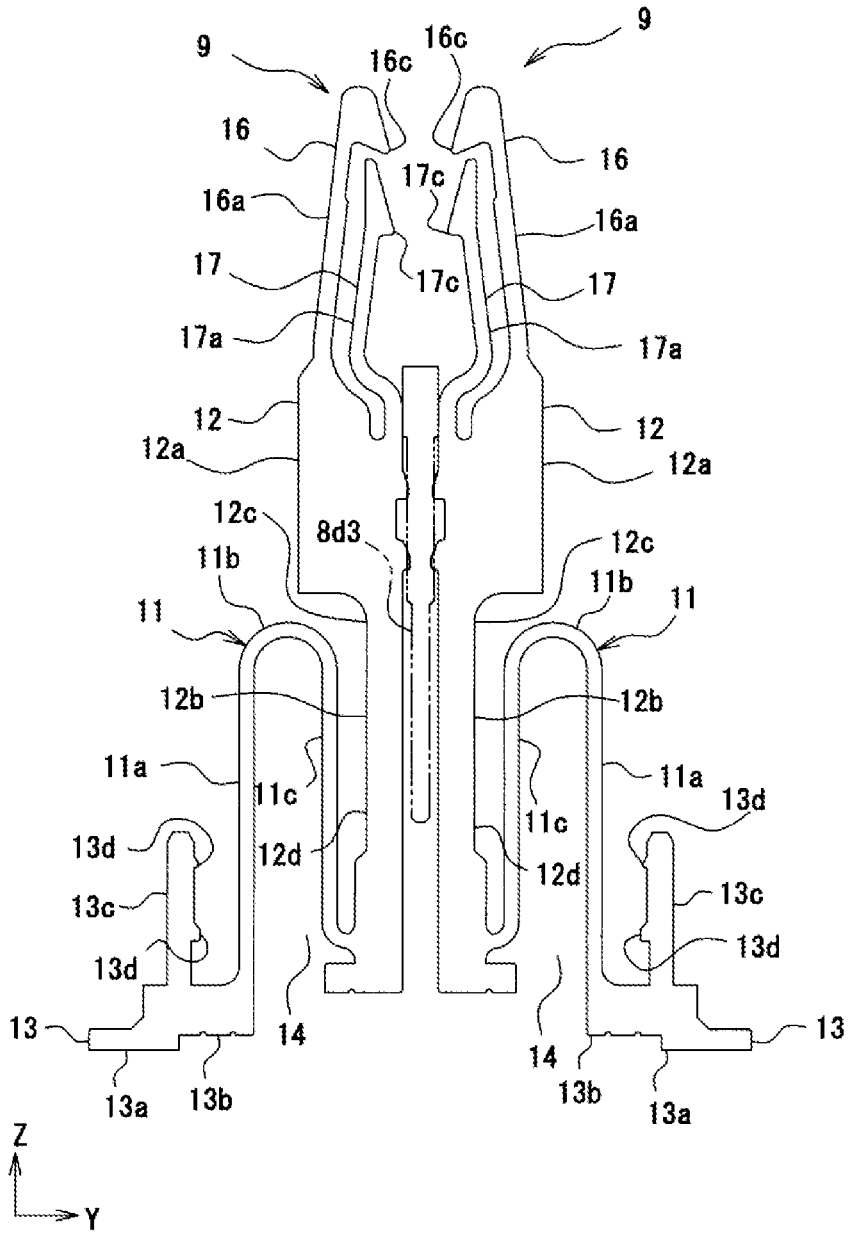
FIG. 13 is a front view of a socket terminal according to a modification.

As illustrated in FIG. 10, the second extension 11*c* extends substantially parallel to the first extension 11*a*. The second extension 11*c* is bent at a lower end thereof and connected to the base 12. The second extension 11*c* includes a spring portion 11*d* that is bent in a crank shape. Because the spring portion 11*d* is formed in the middle of the second extension 11*c*, the distance between the base and a gap-forming portion 11*f* above the spring portion 11*d* is larger than the distance between the base 12 and a gap-forming portion 11*e* below the spring portion 11*d*. In other words, a first movable space 14*a*, which is wide, is formed between the base 12 and the gap-forming portion 11*f* near the hairpin portion 11*b*; and a second movable space 14*b*, which is narrower than the first movable space 14*a*, is formed between the base 12 and the gap-forming portion 11*e* continuous with the base 12.

Base

As illustrated in FIGS. 3 and 5, the base 12 includes an upper portion 12*a*, which has a large width, and the lower portion 12*b*, which has a narrow strip-like shape. The upper portion 12*a* is held between the center wall 8*d*3 and the long-side wall 8*d*1 of the terminal holding portion 8*d* of the movable housing 8*b*. An upper end of the upper portion 12*a* is continuous with the terminal portion 10. The lower portion 12*b*, which has a narrow strip-like shape, protrudes to a position below the long-side wall 8*d*1. A lower end of the lower portion 12*b* is continuous with the second extension 11*c* of the movable portion 11.

A recessed cutout portion 12*c* is formed along an edge of the lower portion 12*b* (of the base 12) facing the second extension 11*c*. Because the cutout portion 12*c* is formed, the width of the lower portion 12*b* in the transverse direction Y is about a half of the width of the upper portion 12*a*. The cutout portion 12*c* is defined by a vertical edge 12*d*, which extends in the insertion/extraction direction Z, and a horizontal edge 12*e*, which extends in the transverse direction Y. The second extension 11*c* is disposed in the recess formed by the cutout portion 12*c*. Thus, the width of the socket terminal 9 in the transverse direction Y can be reduced, and the socket connector 3 can be reduced in size. The horizontal edge 12*e* of the cutout portion 12*c* is substantially flush with the lower end surface of the long-side wall 8*d*1 of the movable housing 8*b*, which has a large thickness, and therefore heat can be smoothly dissipated from the inside of the movable space 14 through the opening 15.

An engagement portion 12*a*1 is formed in the upper portion 12*a*. When the engagement portion 12*a*1 engages with the center wall 8*d*3 of the movable housing 8*b*, the socket terminal 9 is fixed to the movable housing 8*b*. A pressure receiving portion 12*b*1 is formed at an end of the lower portion 12*b* near the board. When assembling the socket connector 3, the socket terminal 9 is pressed into the movable housing 8*b* by pressing the pressure receiving portion 12*b*1.

Terminal Portion

Figure 7:
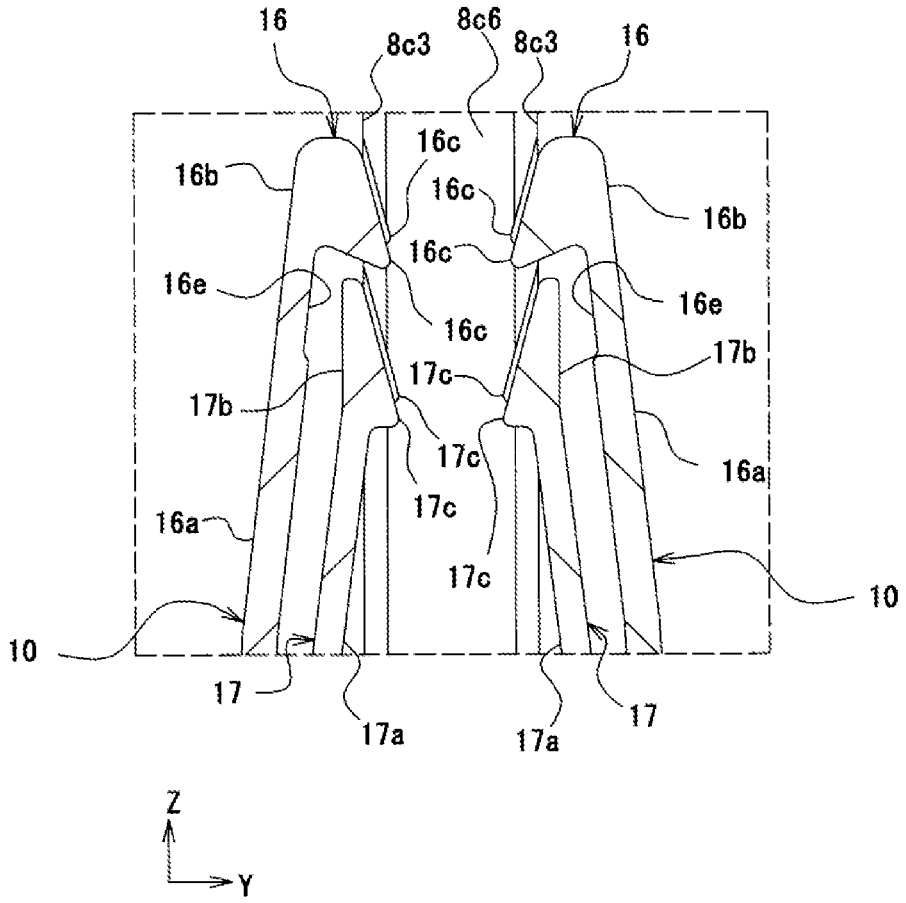
FIG. 7 is an enlarged view of a region R in FIG. 5.
Figure 8:
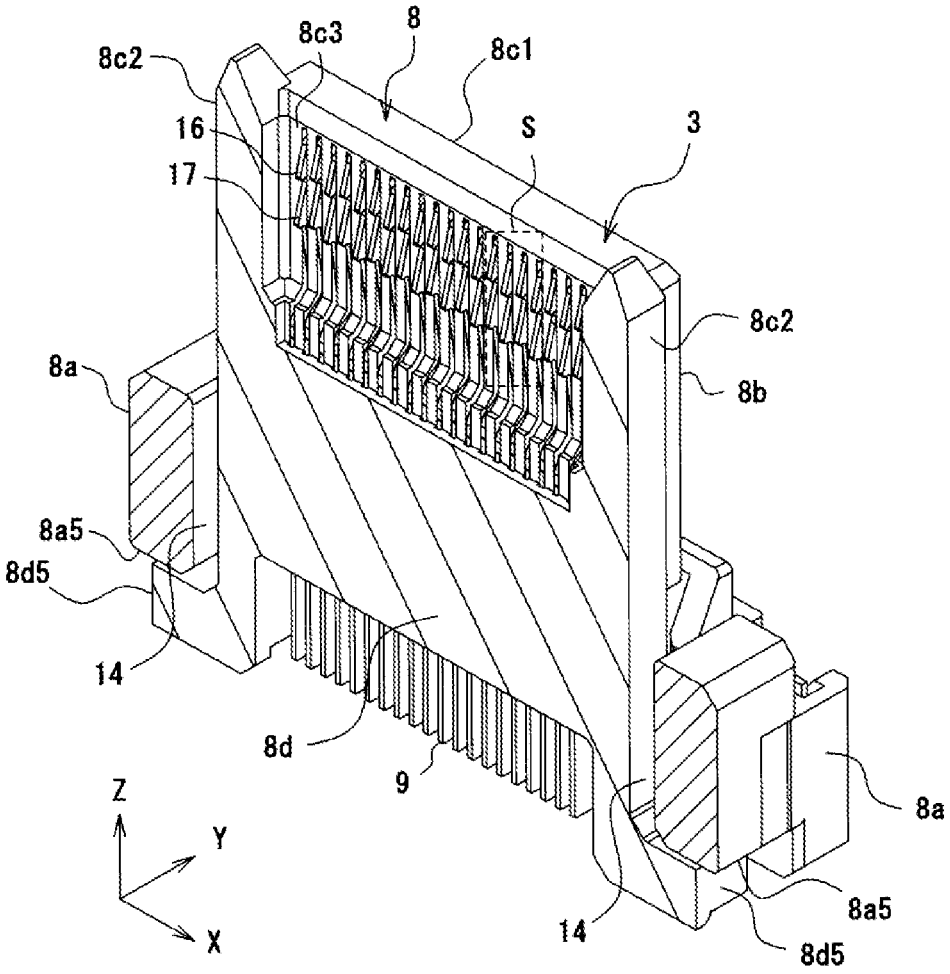
FIG. 8 is a perspective view of the socket connector illustrated in FIG. 6.

As illustrated in FIGS. 5 and 7, the terminal portion 10 includes a front terminal 16 and a rear terminal 17, each extending from the upper end of the base 12 like a cantilever.

Front Terminal

The front terminal 16 includes an elastic piece 16*a* and a contact portion 16*b*. The elastic piece 16*a* protrudes upward from the upper end of the base 12. The contact portion 16*b* is disposed at an end of the elastic piece 16*a* and protrudes in a direction from which the plug terminal 7 comes into contact. In a connected state, a front contact-point portion 16*c* at an end of the contact portion 16*b* contacts the plug terminal 7. The contact portion 16*b* includes a front edge 16*d* above the front contact-point portion 16*c*. The front edge 16*d* has a function of removing foreign substances adhering to the contact portion 7*f* of the plug terminal 7.

A recessed portion 16*e* is formed in a part of an edge of an end portion of the elastic piece 16*a* facing a contact portion 17*b* of the rear terminal 17. The width of the elastic piece 16*a* is partially reduced at the recessed portion 16*e*. When the plug connector 2 is fitted into the socket connector 3 and the plug terminal 7 presses the rear terminal 17 toward the front terminal 16, the end portion of the rear terminal 17 is moved into the recessed portion 16*e*. Therefore, the rear terminal 17 does not easily contact the front terminal 16.

Rear Terminal

The rear terminal 17 includes an elastic piece 17*a* and the contact portion 17*b*. The elastic piece 17*a* extends from an upper end of the base 12. The contact portion 17*b* is disposed at an end of the elastic piece 17*a* and protrudes in a direction from which the plug terminal 7 comes into contact. In a connected state, a rear contact-point portion 17*c* at an end of the contact portion 17*b* contacts with the plug terminal 7. The rear contact-point portion 17*c* is located deeper in the insertion/extraction direction Z than the front contact-point portion 16*c*. When the plug connector 2 is inserted into the socket connector 3, the plug terminal 7 first contacts the front terminal 16 and then contacts the rear terminal 17.

When the plug connector 2 has been connected, a protruding amount by which the rear contact-point portion 17*c* protrudes from the long inner wall 8*c*3 is larger than that of the front contact-point portion 16*c*. Thus, when the plug connector 2 is being connected and the plug terminal 7 presses the rear contact-point portion 17*c* and the front contact-point portion 16*c*, the amount of displacement of the rear contact-point portion 17*c* toward the long-side wall 8*c*1 is larger than the amount of displacement of the front contact-point portion 16*c* toward the long-side wall 8*c*1. In general, provided that the spring constant is the same, the contact pressure increases as the amount of displacement of the terminal increases. Accordingly, because the front contact-point portion 16*c* and the rear contact-point portion 17*c* are disposed as described above, the contact pressure of the rear terminal 17 is larger than that of the front terminal 16. Thus, the rear contact-point portion 17*c*, which is located deeper in the insertion/extraction direction Z than the front contact-point portion 16*c*, can conductively contact the plug terminal 7 securely.

The terminal portion 10 includes two contact-point portions, which are the front contact-point portion 16*c* and the rear contact-point portion 17*c*. Thus, even if a foreign substance, such as dust, enters a space between the contact portion 7*f* and one of the front and rear contact-point portions 16*c* and 17*c*, the other of the front and rear contact-point portions 16*c* and 17*c* can contact the plug terminal 7. As a result, the contact reliability can be increased.

Description of Operational Effects of Electrical Connector

Next, the operational effects of the electrical connector 1 according to the present embodiment will be described.

Reduction in Size of Electrical Connector

The socket terminals 9 each have a flat plate-like shape, which maintains the shape of a flat metal plate and which is not bent in the thickness direction. Therefore, a large number of socket terminals 9 can be arranged at a small pitch, and the socket connector 3 and the electrical connector 1, which are compact in the longitudinal direction X, can be realized.

In the base 12 of the socket terminal 9, the upper portion 12*a*, which is continuous with the terminal portion 10, has a large width in the transverse direction Y. This is because the terminal portion 10 has a multi-terminal multi-contact structure, including the front terminal 16 and the rear terminal 17, in order to obtain the advantages described above. For the terminal portion 10 of this type, it may be possible to form the lower portion 12*b* by extending the upper portion 12*a* in a direction toward the board so as to maintain the width of the upper portion 12*a*. In the present embodiment, however, the width of the lower portion 12*b* is reduced by forming the cutout portion 12*c*, and the second extension 11*c* and substantially a half of the hairpin portion 11*b* of the movable portion 11 are disposed in the recess formed by the cutout portion 12*c*. Thus, as compared with a case where the upper portion 12*a* and the lower portion 12*b* have the same width and the movable portion 11 is disposed so as to be parallel to the lower portion 12*b*, the size of the socket terminal 9 can be reduced in the transverse direction Y and the sizes of the socket connector 3 and the electrical connector 1 can be reduced. As a result, according to the present embodiment, the size of the electrical connector 1 having a floating structure can be reduced in both of the longitudinal direction X and the transverse direction Y. Furthermore, the electrical connector 1 can contribute to reduction in the size of electronic appliances and to high-density mounting of electronic components.

In the electrical connector 1, the movable portion 11 and the lower portion 12*b* of the base 12 are arranged side by side below the terminal portion 10. In some cases, the board 4 and the board 5 may need to be separated from each other by a considerable distance, depending on the types of components mounted thereon and the constraints on the design of various electronic appliances. In such cases, the electrical connector 1 according to the present embodiment can have a large height in the insertion/extraction direction Z while reducing the sizes in the longitudinal direction X and the transverse direction Y, because the terminal portion 10, the movable portion 11, and the lower portion 12*b* of the base 12 of the socket terminal 9 are vertically and serially arranged in the insertion/extraction direction Z.

When the plug connector 2 is being fitted into the socket connector 3, the plug terminal 7 presses the front terminal 16 and the rear terminal 17 outward. In order to prevent the rear terminal 17 from contacting the front terminal 16 at this time, it may be necessary that the rear terminal 17 be separated from the front terminal 16 by a large distance. However, in the electrical connector 1 according to the present embodiment, the recessed portion 16*e* is formed in the edge of the elastic piece 16*a* of the front terminal 16 facing the rear terminal 17. Thus, when the rear terminal 17 is pressed by the plug terminal 7, the contact portion 17*b* of the rear terminal 17 enters the recessed portion 16*e*, and therefore the front terminal 16 can be prevented from contacting the elastic piece 16*a*. Accordingly, even when the front terminal 16 is disposed close to the rear terminal 17 to reduce the width of the upper portion 12*a* of the base 12 in the transverse direction Y, a sufficient space in which the rear terminal 17 is movable can be formed between the front terminal 16 and the rear terminal 17. Therefore, the size of the socket terminal 9 can be reduced in the transverse direction Y.

In the present embodiment, for reasons of design and manufacturing, the distance between each pair of the front contact-point portions 16*c* that face each other is smaller than the distance between each pair of the rear contact-point portions 17*c* that face each other and the protruding amount by which the rear contact-point portion 17*c* protrudes from the long inner wall 8*c*3 of the movable housing 8*b* is larger than that of the front contact-point portion 16*c*. Accordingly, when the plug connector 2 is connected, an amount of displacement of the rear terminal 17 is larger than that of the front terminal 16. Therefore, in a connected state, the rear terminal 17 is located considerably close to the front terminal 16. However, because the front terminal 16 has the recessed portion 16*e* as described above, the size of the electrical connector 1 can be reduced in the transverse direction Y while avoiding contact between the rear terminal 17 and the front terminal 16.

The movable portion 11 includes the crank-shaped spring portion 11*d*. If the crank-shaped spring portion 11*d* were not provided, when the movable housing 8*b* becomes displaced toward the fixed housing 8*a*, an upper part of the second extension 11*c* might contact the base 12 or a lower part of the first extension 11*a* might contact a lower part of the second extension 11*c*. To prevent such contact, it would be necessary that the distance between the second extension 11*c* and the base 12 and the distance between the first extension 11*a* and the second extension 11*c* be large enough to avoid contact. In this case, however, the size of the socket terminal 9 in the transverse direction Y would be increased. For this reason, the crank-shaped spring portion 11*d* if formed in the movable portion 11, so that the first movable space 14*a* having a large size is formed between the base 12 and a part (the gap-forming portion 11*f*) of the second extension 11*c* near the hairpin portion 11*b*. Thus, the second extension 11*c* does not contact the base 12 when the movable housing 8*b* becomes displaced so as to approach the fixed housing 8*a* (see FIGS. 10 and 11). Moreover, although the second movable space 14*b*, which is narrow, is formed between the base 12 and a part (the gap-forming portion 11*e*) of the second extension 11*c* below the spring portion 11*d*, a third movable space 14*d*, which is wide, is formed between the gap-forming portion 11*e* and a part of the first extension 11*a* opposite to the base 12 and near the board. Accordingly, even when the movable housing 8*b* becomes displaced toward the fixed housing 8*a*, a part of the second extension 11*c* near the board (the gap-forming portion 11*e*) does not contact a part of the first extension 11*a* near the board (see FIG. 11).

Structure for Suppressing Flowing-up of Flux

Because the plug terminals 7 include the support portions 7*a*2, the plug housing 6 is located above the board 4 when the plug housing 6 is mounted on the board 4. Thus, flux does not easily adhere to the plug housing 6, and the flux can be prevented from flowing along the plug housing 6 and from entering gaps between the plug housing 6 and the plug terminals 7. Moreover, because the plug terminals 7 include the first separation portions 7*b* and the second separation portions 7*d*, even if flux adheres to the plug housing 6, the first separation portion 7*b* or the second separation portion 7*d* can prevent the flux from flowing up through gaps between the plug housing 6 and the plug terminals 7 due to capillary action.

Because the socket terminals 9 include the support portions 13*b*, the fixed housing 8*a* is located above the board 5 when the socket terminal 9 is mounted on the board 5. Accordingly, flux does not easily adhere to the fixed housing 8*a*, and the flux is prevented from flowing along the fixed housing 8*a* and from flowing into gaps between the fixed housing 8*a* and the socket terminals 9. Even if flux flows into the gaps, the gap-forming portion 14*c*, which is disposed between the fixed housing 8*a* and the first extension 11*a* of the movable portion 11, can prevent the flux from flowing up due to capillary action. Because flowing up of flux can be prevented as described above, it is possible to suppress poor connection between terminals, which may occur due to flow of flux to the contact portion 7*f* of the plug terminal 7 and to the terminal portion 10 of the socket terminal 9.

Improvement of Insertability due to Displaced Contact-point Structure

Figure 9:
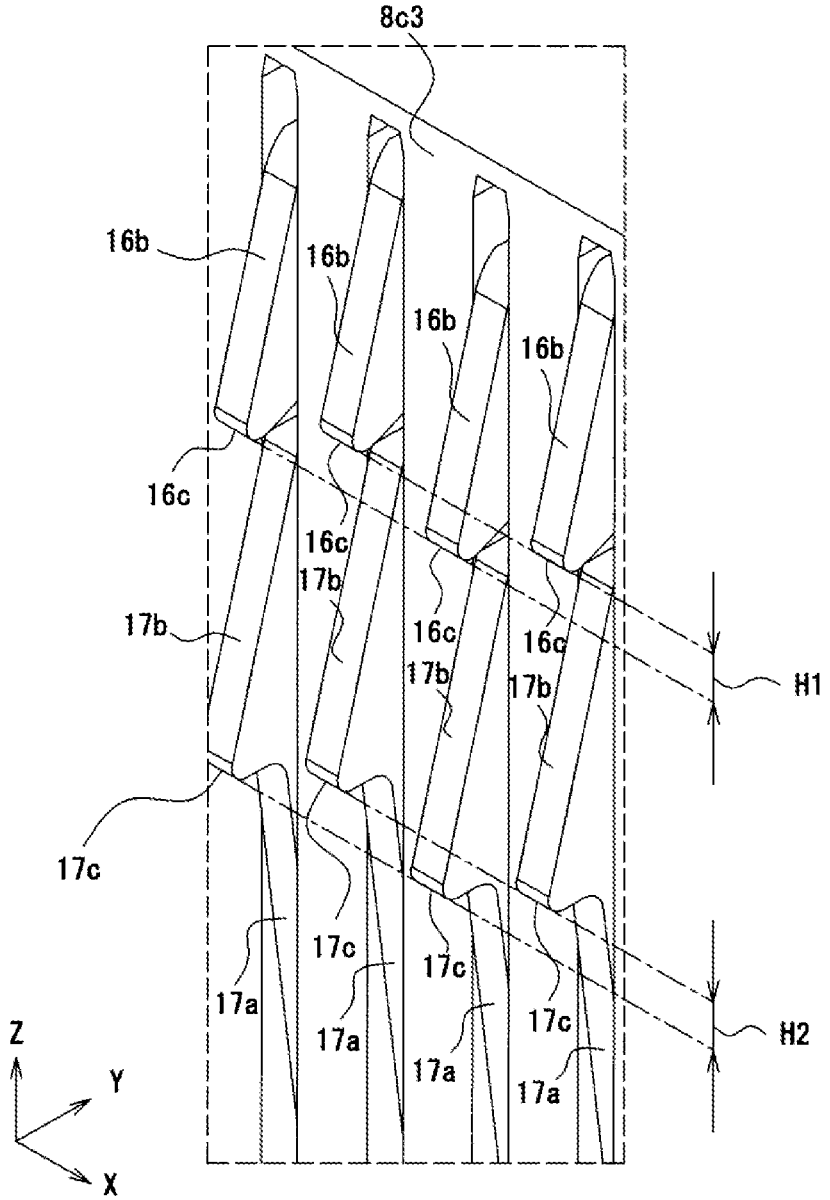
FIG. 9 is an enlarged view of a region S in FIG. 8.

As illustrated in FIGS. 6 to 9, in the socket connector 3, the socket terminals 9 are arranged side by side in the longitudinal direction X. As illustrated in FIG. 9, the front contact-point portions 16*c* of adjacent socket terminals 9 are disposed so as to be displaced from each other by a distance H1 in the insertion/extraction direction Z. Likewise, the rear contact-point portions 17*c* of adjacent socket terminals 9 are disposed so as to be displaced from each other by a distance H2 in the insertion/extraction direction Z. When the plug connector 2, which is a connection object, is fitted into the socket connector 3, the end of the plug terminal 7 first presses the contact portion 16*b* of the front terminal 16 to displace the contact portion 16*b* to an outer side of the socket housing 8 and to cause the contact portion 16*b* to pass over the front contact-point portion 16*c*. Subsequently, the end of the plug terminal 7 presses the contact portion 17*b* of the rear terminal 17 to displace the contact portion 17*b* in the same way and to cause the contact portion 17*b* to pass over the rear contact-point portion 17*c*. Thus, the front contact-point portion 16*c* and the rear contact-point portion 17*c* come into contact with the contact portion 7*f* of the plug terminal 7, thereby finishing connection of the plug connector 2 and the socket connector 3.

When an operator (not shown) presses the contact portion 16*b* of the front terminal 16 and the contact portion 17*b* of the rear terminal 17, the operator receives a resistance from the plurality of socket terminals 9 of the socket connector 3. Therefore, the operator has to apply a large force to fit the plug connector 2 into the socket connector 3. Moreover, when the end of the plug terminal 7 passes over the front contact-point portion 16*c* and when the end of the plug terminal 7 passes over the rear contact-point portion 17*c*, the operator feels a resistance with his/her hand. Accordingly, the operator may misunderstand that the plug connector 2 has been fitted into the socket connector 3 when the end of the plug terminal 7 has passed over the front contact-point portion 16*c* and may stop inserting the plug connector 2 in a semi-fitted state. Moreover, if the operator tries to forcibly insert the plug connector 2 into the socket connector 3 with a large force, the plug connector 2 may become obliquely fitted into the socket connector 3 or the socket terminal 9 may become buckled and damaged.

For this reason, with the electrical connector 1 according to the present embodiment, the plug terminals 7 come into contact with the socket terminals 9 at different timings, because adjacent front contact-point portions 16*c* are displaced from each other and adjacent rear contact-point portions 17*c* are displaced from each other in the insertion/extraction direction Z. Thus, the number of the socket terminals 9 that simultaneously contact the plug terminals 7 can be reduced, and the insertion force can be dispersed. Accordingly, an operator can fit the plug connector 2 into the socket connector 3 with a smaller force, so that occurrences of semi-fitting, oblique fitting, buckling, and the like can be suppressed.

Function of Removing Foreign Substance

When the plug connector 2 has been fitted into the socket connector 3, the plug terminal 7 comes into contact with and becomes conductively connected to the socket terminal 9. Foreign substances, such as fragments of the board or dust, may adhere to the contact portion 7*f* of the plug terminal 7. If the rear contact-point portion 17*c* contacts the contact portion 7*f* of the plug terminal 7 in such a state, the foreign substances may be interposed between the rear contact-point portion 17*c* and the contact portion 7*f* of the plug terminal 7. In this case, conductive connection between the rear contact-point portion 17*c* and the plug terminal 7 might become unstable. However, as illustrated in FIGS. 3, 5, and 7, the front contact-point portion 16*c* is disposed above the rear contact-point portion 17*c*, and, when the plug connector 2 is fitted into the socket connector 3, the front contact-point portion 16*c* and the rear contact-point portion 17*c* successively and slidably contact the contact portion 7*f* of the plug terminal 7. Thus, the front contact-point portion 16*c* and the front edge 16*d* thereof can wipe off foreign substances adhering to the contact portion 7*f* of the plug terminal 7. Moreover, the rear contact-point portion 17*c* contact parts of the contact portion 7*f* of the plug terminal 7 from which foreign substances have been wiped off, and therefore the rear contact-point portion 17*c* can be conductively connected to the plug terminal 7 with no foreign substances interposed therebetween. As a result, the contact reliability can be increased.

The electrical connector 1 according to the present embodiment has a small size in the transverse direction Y even though the electrical connector 1 includes the movable portion 11. Thus, by using the electrical connector 1, it is possible to realize reduction in the sizes of electrical appliances and high-density mounting of electronic components. By using the electrical connector 1 according to the present embodiment, occurrence of defective contact, which is caused by flowing up of flux and adhesion of flux to the terminal portion 10, can be reduced. Moreover, because the contact pressure of the rear terminal 17 is higher than that of the front terminal 16, the rear terminal 17 can securely contact the plug terminal 7. Furthermore, by displacing the positions of adjacent front contact-point portions 16*c* from each other or by displacing the positions of adjacent rear contact-point portions 17*c* from each other, the insertability of the electrical connector 1 can be improved. As a result, the electrical connector 1 has high contact reliability.

Modifications of the Embodiment

In the embodiment described above, the electrical connector 1 includes the front terminal 16 and the rear terminal 17. However, the electrical connector 1 may include only one elastic piece or only one contact-point portion, or one elastic piece may elastically support a plurality of contact-point portions. In any of these cases, the electrical connector 1 can be reduced in size in the transverse direction Y.

In the embodiment described above, the electrical connector 1 has two contact point portions, which are the front contact-point portion 16*c* and the rear contact-point portion 17*c*. Alternatively, the electrical connector 1 may have only one contact-point portion.

In the movable portion 11 according to the embodiment described above, the second extension 11*c* is disposed in the recess formed by the cutout portion 12*c* and the first extension 11*a* is disposed outside the cutout portion 12*c*. Alternatively, the first extension 11*a* may be also disposed in the cutout portion 12*c*. In this case, the electrical connector 1 can be made compact in the transverse direction Y.

In the embodiment described above, the horizontal edge 12*e* of the cutout portion 12*c* is flush with a lower end surface of the long-side wall 8*d*1 of the movable housing 8*b*. Alternatively, the lower end surface may be disposed above the horizontal edge 12*e*. In this case, the openings 15 are made larger and heat can be dissipated more efficiently.

In the embodiment described above, the second extension 11*c* includes the spring portion 11*d*. Alternatively, the spring portion 11*d* may be omitted, and the second extension 11*c* may be formed so as to become separated from the lower portion 12*b* of the base 12 with increasing distance from one end thereof near the base 12 to the other end thereof near the hairpin portion 11*b* (see FIG. 12). The second extension 11*c* may extend in the insertion/extraction direction Z, and the vertical edge 12*d* of the cutout portion 12*c* may be formed so as to become nearer to the center wall 8*d*3 from a lower part thereof toward an upper part thereof. For example, the vertical edge 12*d* of the cutout portion 12*c* may be inclined toward the center wall 8*d*3 from the lower part toward the upper part or may have a stepped shape (see FIG. 13). Also in these cases, the width of a gap between the second extension 11*c* and the cutout portion 12*c* at an upper end portion near the hairpin portion 11*b* can be made larger than that at a lower end portion that is continuous with the base 12.

In the embodiment described above, the contact pressure of the rear terminal 17 is higher than that of the front terminal 16. Alternatively, the contact pressure of the front terminal 16 may be higher than that of the rear terminal 17. In this case, the front contact-point portion 16*c* can be made to securely contact the plug terminal 7. Further alternatively, the contact pressure of the front terminal 16 may be substantially the same as that of the rear terminal 17.

In the embodiment described above, adjacent front contact-point portions 16*c* and adjacent rear contact-point portions 17*c* are respectively displaced from each other in the insertion/extraction direction Z. Alternatively, for example, sets of front contact-point portions 16*c* that are disposed adjacent to each other in the longitudinal direction X or sets of rear contact-point portions 17*c* that are disposed adjacent to each other in the longitudinal direction X may be respectively displaced from each other in the insertion/extraction direction Z. In this case, by disposing sets of, for example, three contact-point portions so as to be displaced from each other, concentration of resistance on specific positions can be avoided and an operation of connecting the connectors can be performed easily.

In the embodiment described above, the plug connector 2 is used an example of a connection object that is connected to the socket connector 3. Alternatively, the connection object may be any one of connectors, boards (hard boards and FPCs), cables (flexible flat cables and the like), as long as it can successively contact the front terminal 16 and the rear terminal 17 of the socket terminal 9 in the insertion direction and can be conductively connected to the front terminal 16 and the rear terminal 17. In this case, the structure of the socket connector 3 may be changed appropriately in accordance with the structure of the connection object.

What is claimed is:

1. An electrical connector comprising:

a housing; and a plurality of terminals fixed to the housing, wherein the housing includes a fixed housing fixed to a board, and a movable housing that is displaceable relative to the fixed housing, wherein each of the terminals includes a board connection portion fixed to the housing, a base fixed to the movable housing, a terminal portion that, in the movable housing, contacts and becomes conductively connected to a conductive connection portion of a connection object inserted into the movable housing, and a movable portion that is connected to the board connection portion at one end portion thereof and connected to the base at the other end portion thereof and that elastically supports the movable housing in such away that the movable housing is displaceable relative to the fixed housing, wherein the terminal portion includes a front terminal portion, and a rear terminal portion, wherein the front terminal portion includes a front contact-point portion and an elastic piece, the front contact-point portion slidably contacting the conductive connection portion of the connection object when the connection object is inserted into the movable housing and wiping off a foreign substance adhering to the conductive connection portion, the elastic piece supporting the front contact-point portion so as to be elastically displaceable, wherein the rear terminal portion includes a rear contact-point portion and an elastic piece, the rear contact-point portion sliding along a sliding path of the front contact-point portion in an insertion direction in which the connection object is inserted into the movable housing and conductively contacting the conductive connection portion from which the foreign substance has been wiped off by the front contact-point portion, the elastic piece supporting the rear contact-point portion so as to be elastically displaceable, wherein the front contact-point portion and the elastic piece of the front-contact portion, and the rear contact-point portion and the elastic piece of the rear contact-point portion are each formed so as to maintain a plate surface of a flat metal plate, wherein positions of the front contact-point portions that are adjacent to each other are displaced from each other so that the front contact-point portions contact the connection object at different positions in the insertion direction, wherein positions of the rear contact-point portions that are adjacent to each other are displaced from each other so that the rear contact-point portions contact the connection object at different positions in the insertion direction, and wherein the base and the movable portion are connected to each other in the fixed housing and are arranged side by side in the fixed housing in such a way that the base and the movable portion extend in the insertion direction.

2. The electrical connector according to claim 1, wherein a contact pressure with which the rear contact-point portion of the rear terminal portion contacts the connection object is higher than a contact pressure with which the front contact-point portion of the front terminal portion contacts the connection object.

3. The electrical connector according to claim 1, wherein a protruding amount by which the rear contact-point portion protrudes in a direction in which the rear contact-point portion and the front contact-point portion come into contact with the conductively contact portion of the connection object is larger than that of the front contact-point portion.

4. The electrical connector according to claim 1, wherein the board connection portion includes a connection portion that is connected to a board surface of the board and a support portion that supports the housing so as to be separated from the board, the support portion suppressing flow of flux from the connection portion due to capillary action.

5. An electrical connector connectable to the electrical connector according to claim 1, comprising:

a housing; and a plurality of terminals, wherein each of the terminals includes a board connection portion connected to a board, a fixed portion that is continuous with the board connection portion, that extends in an insertion/extraction direction of the electrical connector according to claim 1, and that is fixed to an inner wall of the housing, and a contact surface that is continuous with the fixed portion and that is connected to a corresponding one of the terminals of the electrical connector according to claim 1, and wherein the fixed portion includes an insulation portion that is partially separated from the inner wall of the housing and forming a gap between the insulation portion and the inner wall, the insulation portion suppressing flow of flux through the fixed portion due to capillary action.

6. The electrical connector according to claim 5, wherein the board connection portion includes a connection portion that is connected to a board surface of the board, and a support portion that supports the housing so as to be separated from the board, the support portion suppressing flow of flux through the connection portion due to capillary action.

* * * * *